US005678328A

United States Patent [19]

Schmidt et al.

[11] Patent Number: 5,678,328

[45] Date of Patent: Oct. 21, 1997

[54] HEEL AND SOLE STRUCTURE WITH OPPOSITE CAVITIES

[75] Inventors: Karl M. Schmidt, Woodside; Stuart E. Jenkins, Thousand Oaks, both of Calif.; Harry W. Edwards, Barrington, Ill.; George S. Cole, Pebble Beach, Calif.

[73] Assignee: Energaire Corporation, Pebble Beach, Calif.

[21] Appl. No.: 565,387

[22] Filed: Nov. 30, 1995

[51] Int. Cl.[6] ..... A43B 13/20

[52] U.S. Cl. ..... 36/29; 36/28; 36/35 B

[58] Field of Search ..... 36/3 R, 3 B, 28, 36/29, 35 B, 25 R

[56] References Cited

U.S. PATENT DOCUMENTS

| | | | |
|---|---|---|---|
| 508,034 | 11/1893 | Moore . | |
| 547,645 | 10/1895 | LaCroix . | |
| 850,327 | 4/1907 | Tauber . | |
| 1,193,608 | 8/1916 | Poulson . | |
| 1,314,997 | 9/1919 | Winter et al. | 36/29 |
| 1,422,854 | 7/1922 | Hart | 36/35 B |
| 1,605,985 | 11/1926 | Rasmussen . | |
| 2,080,499 | 5/1937 | Nathansohn . | |
| 3,225,463 | 12/1965 | Burnham . | |
| 4,237,625 | 12/1980 | Cole et al. | 36/29 |
| 4,358,902 | 11/1982 | Cole et al. | 36/29 |
| 4,458,430 | 7/1984 | Peterson . | |
| 4,577,417 | 3/1986 | Cole | 36/29 |
| 4,856,208 | 8/1989 | Zaccaro | 36/29 |
| 5,375,346 | 12/1994 | Cole et al. | 36/29 |

FOREIGN PATENT DOCUMENTS

| | | | |
|---|---|---|---|
| 448945 | 2/1913 | France . | |
| 720257 | 2/1932 | France . | |
| 1685758 | 1/1973 | Germany | 36/29 |
| 2800359 A | 7/1979 | Germany . | |
| 338266 | 11/1930 | United Kingdom . | |
| 2114425 | 2/1982 | United Kingdom . | |

*Primary Examiner*—M. D. Patterson
*Attorney, Agent, or Firm*—Emrich & Dithmar

[57] ABSTRACT

A shoe sole and heel structure is provided. The structure includes an outsole having interior and exterior surfaces, and a bulge projecting from the exterior surface, with the bulge defining a first cavity opening at the interior surface. The structure also includes a midsole overlying the outsole. The midsole has an outsole-facing surface and a foot-facing surface and a second cavity opening at the outsole-facing surface. The first cavity cooperates with a portion of the midsole to define a first pocket and the second cavity cooperates with a portion of the outsole to define a second pocket. The structure also includes a passageway disposed between the first and second pockets for fluid communication between the first pocket and the second pocket. The interior surface of the outsole is hermetically attached to the outsole-facing surface of the midsole to form a member having a heel portion and a sole portion and so that fluid at atmospheric pressure is permanently located in the space jointly defined by the first and second pockets and the passageway. One of the pockets can be disposed in the heel portion and the other of the pockets can be disposed in the sole portion so that in striding fluid alternates through the passageway between the pockets so as to provide shock absorption and an alternate lifting effect by the pockets which provide forward thrust both in the heel portion and the sole portion that facilitates moving.

19 Claims, 5 Drawing Sheets

HEEL AND SOLE STRUCTURE WITH OPPOSITE CAVITIES

BACKGROUND OF THE INVENTION

1. Field of the Invention

The present invention relates to shoe sole and heel constructions and, in particular, to such constructions with fluid-filled cavities for providing cushioning and forward thrust.

2. Description of the Prior Art

Various types of shoe sole and heel constructions having fluid-containing cavities have heretofore been provided, such constructions being disclosed, for example, in U.S. Pat. Nos. 4,237,625, 4,358,902, 4,577,417, 5,375,346 and 5,416,986.

These patents disclose a molded outer sole and heel member which has downwardly projecting heel and metatarsal bulges molded therein to define cavities and a passageway extending between the cavities. Air or other fluid, at atmospheric pressure, moves back and forth between the cavities through the passageway during movement of a person wearing the shoe.

These prior sole and heel structures have provided cushioning for the user's foot and have also provided forward thrust which facilitates walking or running movements. These bulges usually, however, prevent the member from having an exterior flat portion in the heel and sole portion of the outsole which limits the versatility of the shoe. Additionally, these bulges can tend to produce a lateral instability in the shoe, causing the shoe to tilt laterally inwardly or outwardly in use, resulting in pronation of the wearer's feet. For example, in walking and jogging gaits, wherein the initial shoe strike is at the heel, the initial point of impact is typically at the laterally outer side of the heel, i.e., at the right side of the right heel and the left side of the left heel. Thus, there is a tendency for the fluid in the heel cavity to move from side to side, as well as forwardly toward the metatarsal cavity. Though this instability has been alleviated by providing downwardly projecting stabilizing structures adjacent to the bulges or by reconfiguring the fluid flow and bulge configurations, shoes incorporating these prior structures do not provide a flat sole or heel and, therefore, cannot be used for all applications.

Other shoe sole and heel structures include internal interconnected air cavities in the midsole of a shoe. These structures suffer from, among other things, poor fluid flow from one cavity to another, thereby decreasing the cushioning efficiency of each cavity.

SUMMARY OF THE INVENTION

It is a general object of the invention to provide an improved shoe sole and heel structure which avoids the disadvantages of prior structures while affording additional structural and operational advantages.

An important feature is the provision of a shoe sole and heel structure which is of relatively simple and economical construction.

A still further feature of the invention of a shoe sole and heel structure which has a substantially flat external portion which provides improved lateral stability.

Yet another important feature of the invention is the provision of a shoe sole and heel structure of the type which includes fluid-filled cavities and communicating passageways therebetween, which optimize the cushioning effect of the fluid.

These and other features of the invention are attained by providing a shoe sole and heel structure including an outsole having interior and exterior surfaces and a bulge projecting from the exterior surface, the bulge defining a first cavity opening at the interior surface. The structure also includes a midsole overlying the outsole, the midsole having an outsole-facing surface and a foot-facing surface and a second cavity opening at the outsole-facing surface. The structure further includes means for hermetically attaching the interior surface of the outsole to the outsole-facing surface of the midsole to form a member having a sole portion and a heel portion, wherein the first cavity cooperates with a portion of the midsole to define a first pocket and the second cavity cooperates with a portion of the outsole to define a second pocket. A passageway in the member provides fluid communication between the first and second pockets. Fluid at atmospheric pressure is permanently disposed in the space jointly defined by the first and second pockets and the passageway. At rest, a foot in a shoe incorporating the structure is cushioned comfortably on the fluid in the pockets.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
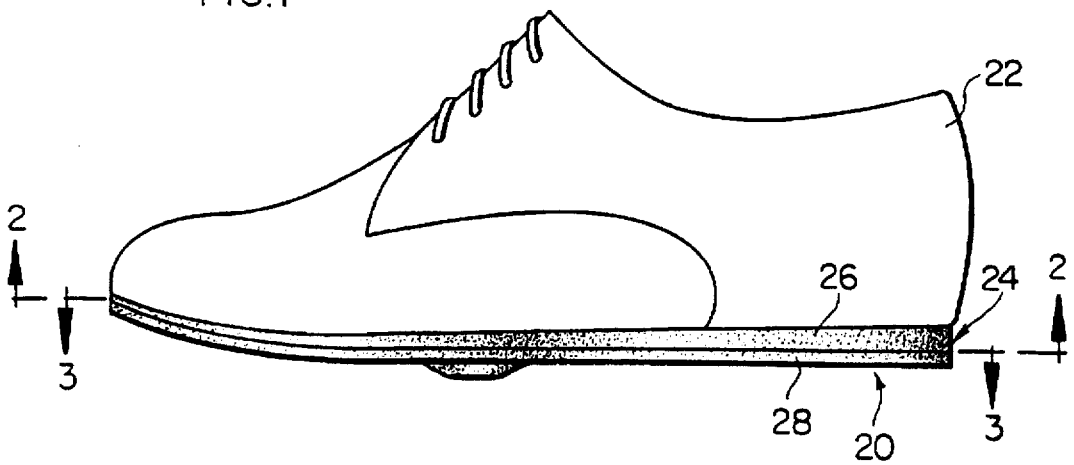
FIG. 1 is a side elevational view of a shoe incorporating a sole and heel member in accordance with an embodiment of the present invention.
Figure 2:
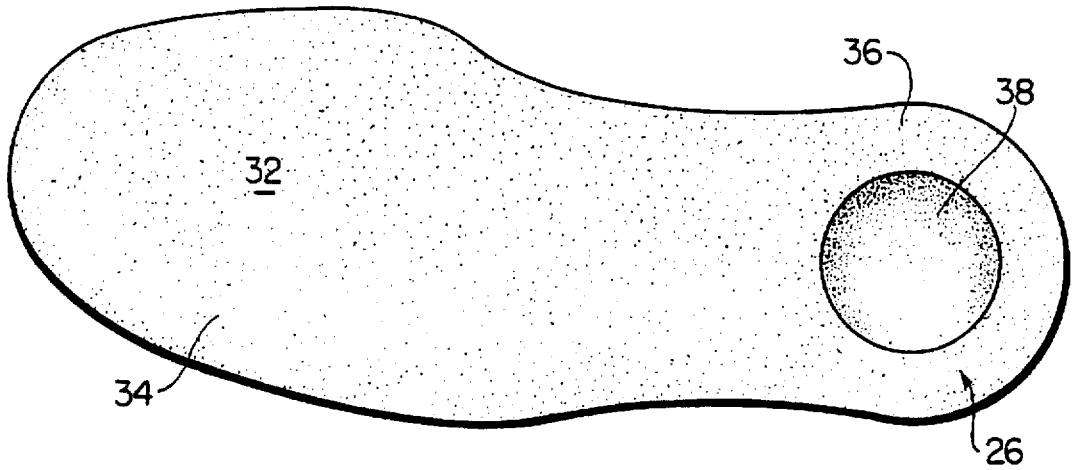
FIG. 2 is a bottom plan view of the midsole of the shoe of FIG. 1, taken generally along the line 2—2 in FIG. 1.

Referring to FIG. 1, there is illustrated a shoe 20 having a conventional upper portion 22, commonly referred to as a last. The shoe 20 also includes a two-piece outer sole and heel member 24 which includes a midsole 26 overlying an outsole 28. The midsole 26 has a generally wedge shape whereby the shoe is referred to as being of the "wedge" type. Referring also to FIGS. 2–5, the midsole 26 has an upwardly facing surface 30 which faces a wearer's foot or a sock liner (not shown). The midsole 26 also has a downwardly facing surface 32 which faces the outsole 28. As discussed in greater detail below, the midsole 26 may be a molded piece made out of a light-weight, generally non-porous material which prevents the transmission of fluids, such as air, therethrough. Useful midsole materials include molded polyurethane and EVA. The midsole 26, as seen in FIGS. 2 and 5, also has a sole portion 34 located under the sole of a wearer's foot and a heel portion 36 located under the heel of a wearer's foot. As seen in FIGS. 2 and 5, the heel portion 36 of the midsole 26 includes a part-spherical heel cavity 38 which opens downwardly at the downwardly facing surface 32. The cavity 38 may be formed during the molding of the midsole 26 or by cutting out a portion of the pre-molded midsole 26.

The outsole 28 is an elongated, thin member of one-piece molded construction, preferably made of a highly flexible, highly wear-resistant material, such as rubber. A very useful rubber is a rubber sold under the brand name INDY 500 and made by Goodyear Tire and Rubber Company.

The outsole 28 has an interior surface 40 which faces the midsole 26 and an exterior surface 42 which is subject to constant engagement with the pavement or other underlying support surface, which will hereinafter be referred to as the "ground". The outsole also has a sole portion 44 located under the sole portion 34 of the midsole and the sole of a wearer's foot and a substantially flat heel portion 46 located under the heel portion 36 of the midsole 26 and the heel of the wearer's foot.

A metatarsal bulge 48 is molded into the sole portion 44 in the metatarsal region thereof and projects downwardly from the exterior surface 42. The metatarsal bulge 48 extends generally laterally across the sole portion 44 and underlies the metatarsal ball area of a wearer's foot for which the sole and heel member 24 is sized. The metatarsal bulge 48 defines a kidney-shaped metatarsal cavity 50 which opens upwardly at the interior surface 40.

A channel cavity 52 is molded into the outsole 28 and opens upwardly at the interior surface 40. The channel cavity 52 extends from a first end 54 which communicates with the kidney-shaped metatarsal cavity 50 to a second end 56 disposed in the heel portion 46.

An adhesive is disposed between the interior surface 40 of the outsole 28 and the downwardly-facing surface 32 of the midsole 26 for fixedly securing the two together in a fluid-tight manner. In this regard, as discussed above, it will be appreciated that the midsole 26 and the outsole 28 are formed of fluid-impermeable materials and are also resilient to accommodate flexing during use of the shoe 20. Thus, the midsole 26 and the outsole 28 cooperate to hermetically seal and form metatarsal and heel pockets 60 and 62 and a restricted passageway 64, permanently trapping air or other fluid at atmospheric pressure therein.

Metatarsal pocket 60 is defined by the metatarsal cavity 50 and the portion of the midsole 26 overlying the cavity 50. Restricted passageway 64 is defined by channel cavity 52 and the portion of the midsole 26 overlying the channel cavity 52. Heel pocket 62 is defined by the heel cavity 38 and the portion of the outer sole and heel member 24 underlying the part-spherical heel cavity.

Figure 3:
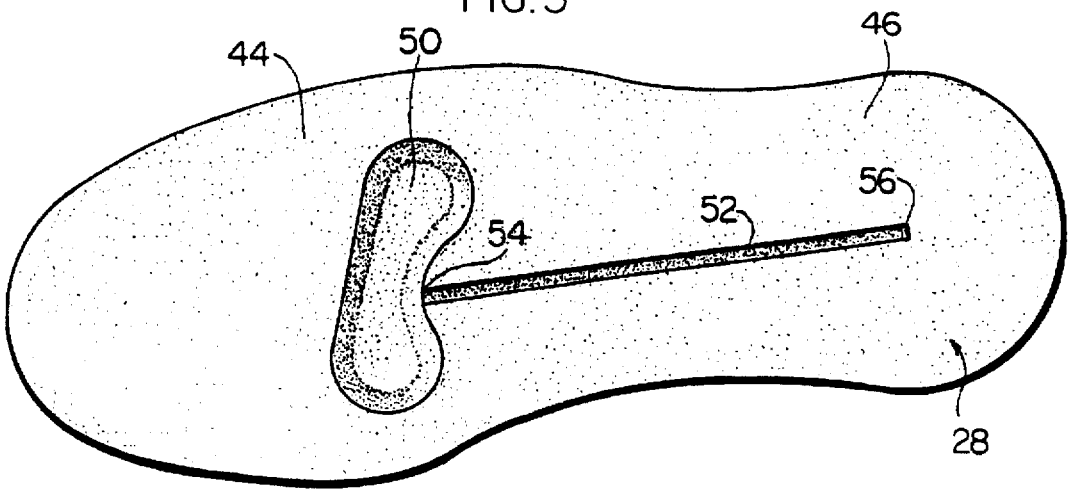
FIG. 3 is a top plan view of the outsole of the shoe of FIG. 1, taken generally along the line 3—3 in FIG. 1.
Figure 4:
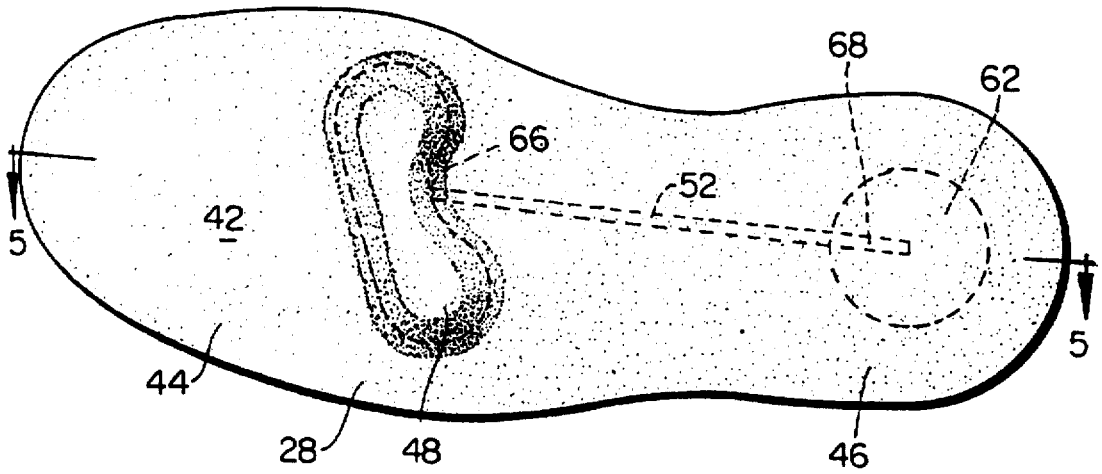
FIG. 4 is a bottom plan view of the shoe of FIG. 1.
Figure 5:
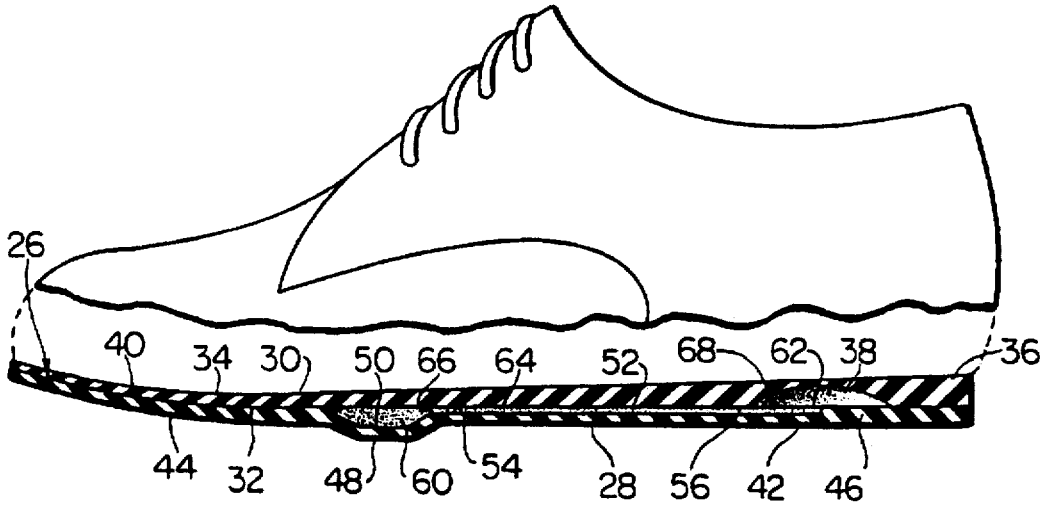
FIG. 5 is a view similar to FIG. 1 with the sole and heel member shown in section taken along the line 5—5 of FIG. 4.

As best seen in FIGS. 3–5, restricted passageway 64 has a first opening 66 by the first end 54 of the channel cavity 52 which opens into the metatarsal pocket 60 and a second opening 68 by the second end 56 of the channel cavity 52 which opens upwardly into the heel pocket 62. The restricted passageway 64 thereby allows the metatarsal pocket 60 to fluidly communicate with the heel pocket 62.

In use, the air in pockets 60, 62 provide a cushioning effect. In walking and running, the heel portion 46 of the outsole 28 first comes in contact with the ground and the heel of a wearer's foot exerts pressure on the midsole 26 above the heel pocket 62. The force of the ground contacting the heel portion 46 of the outsole 28 and the force of the wearer's heel on the midsole 26 causes the air to be compressed in the heel pocket 62 and forced through the passageway 64 into the metatarsal pocket 60. As the heel portion lifts off the ground and the metatarsal bulge 48 contacts the ground, air in metatarsal pocket 60 is forced through passageway 64 back into heel pocket 62 to give a lifting effect. Thus, during striding, such as walking and running, the air moves back and forth between the pockets 60 and 62 through the passageway 64 to give an alternating lifting effect and provide thrust both at the metatarsal ball area and in the heel area that facilitates walking and running.

The volume of the heel pocket 62 is smaller than the volume of the metatarsal pocket 60. Since, unlike the metatarsal pocket 60, no portion of the heel pocket 62 is ever in direct contact with the ground, less force is exerted on the heel pocket 62 than on the metatarsal pocket 60 when they are respectively compressed. Since the volume of the heel pocket 62 is smaller than the metatarsal pocket 60, it is believed that its fluid pressure is higher when it is fully filled with fluid than is the pressure in the metatarsal pocket 60 when it is fully filled. Since the heel pocket 62 is at higher pressure, not as much force is required to be exerted on the heel pocket 62 to cause the fluid to quickly flow through restricted passageway 64 into metatarsal pocket 60 to raise the desired alternate lifting and cushioning effect.

As best seen in FIGS. 1, 4, and 5, since no portion of the heel pocket 62 projects from the exterior surface 42 of the outsole 28, the exterior surface 42 of the heel portion 46 of the outsole 28 is generally flat and planar. This planarity provides increased lateral stability as compared to a shoe which has a bulge (which forms a portion of a heel air pocket) which extends from the heel portion of an outsole and has no other means for aiding stability. For example, when the heel portion of such a shoe pocket strikes the ground, typically at the laterally outer side of heel, a portion of the air in the heel pocket will be forced laterally within the heel pocket which might tend to cause a tilting or rocking of the wearer's foot. Since the heel portion 46 of the outsole 28 is flat and the heel pocket 62 is not on the exterior surface 42 but is located within the interior of the outer sole and heel member 24 and has a smaller volume than a pocket having a portion disposed on the exterior surface, this instability is minimized.

Figure 6:
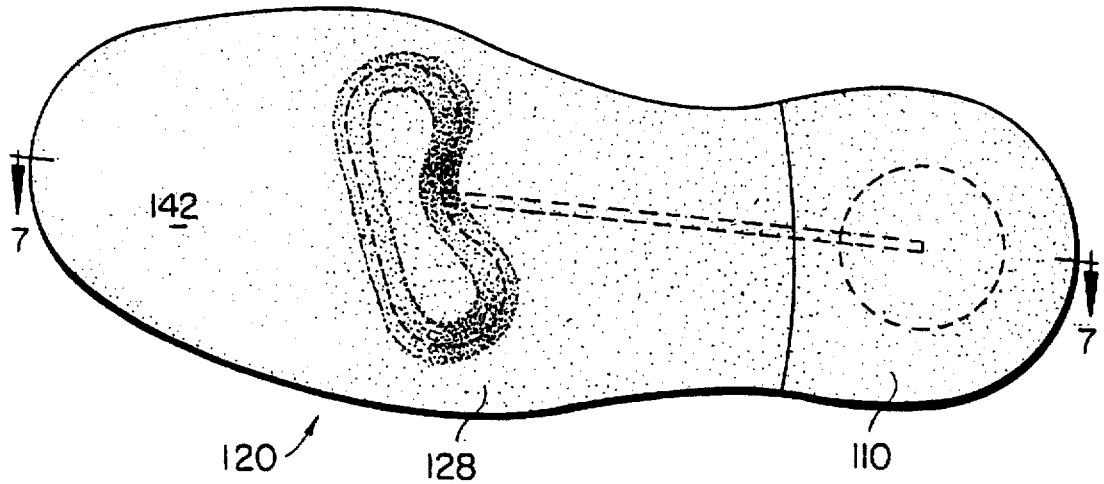
FIG. 6 is a bottom plan view similar to FIG. 4 of a shoe having a similar sole and heel member with an external heel attached to the heel portion of the member.
Figure 7:
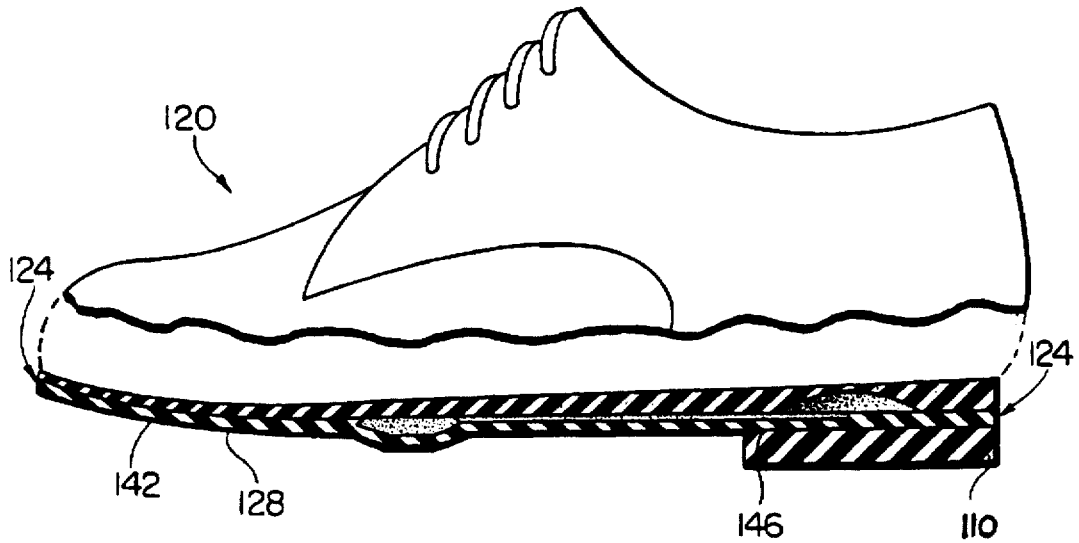
FIG. 7 is a view similar to FIG. 5 of the shoe of FIG. 6, with the sole and heel member shown in section taken along the line 7—7 of FIG. 6.

The planarity of the heel portion also makes the shoe more versatile. For example, spikes such as for golf or other sports can be placed on the heel portion 46 of the outsole 28. Further, the planarity allows the outer sole and heel member 24 to be used with shoes requiring heels. As seen in FIGS. 6–7, a shoe 120 includes an outer sole and heel member 124 substantially identical to the outer sole and heel member 24 of FIGS. 1–5. The member 124 has an outsole 128 with an exterior surface 142 which is generally flat and planar at its heel portion 146. This planarity allows the shoe 120 to have a heel 110 attached to the exterior surface 142 of the heel portion 146 of the outsole 128.

Additionally, the present invention is extremely useful with women's high heel shoes. Since the outer sole and heel members of the present invention do not require a bulge at the heel portion, women's high heels could also be attached to the heel portion of a properly shaped outer sole and heel member.

As seen in FIGS. 8–12, an alternative embodiment of the present invention is illustrated. Unlike the embodiment shown in FIGS. 1–5, a portion of the heel pocket contacts the ground while no portion of the metatarsal pocket comes in contact with the ground.

Figure 8:
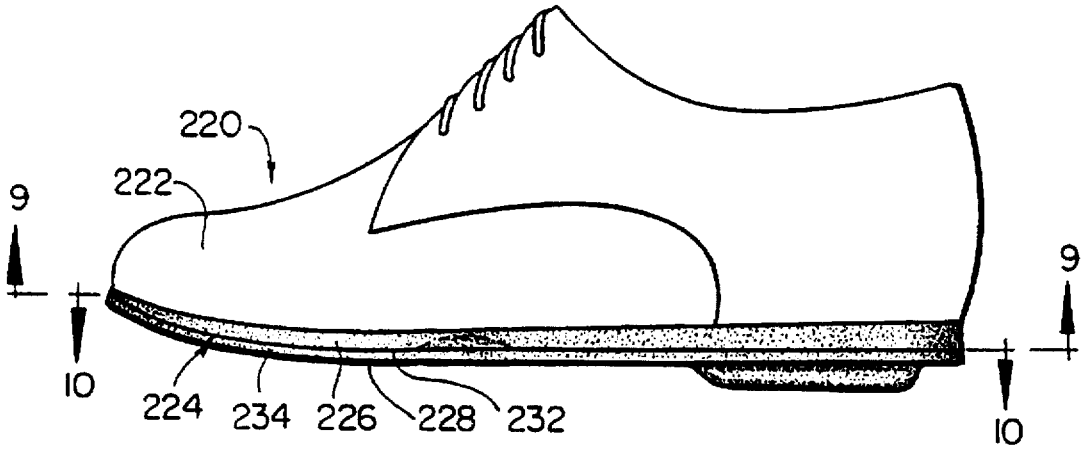
FIG. 8 is a view similar to FIG. 1 of a shoe incorporating a sole and heel member in accordance with another embodiment of the present invention.
Figure 9:
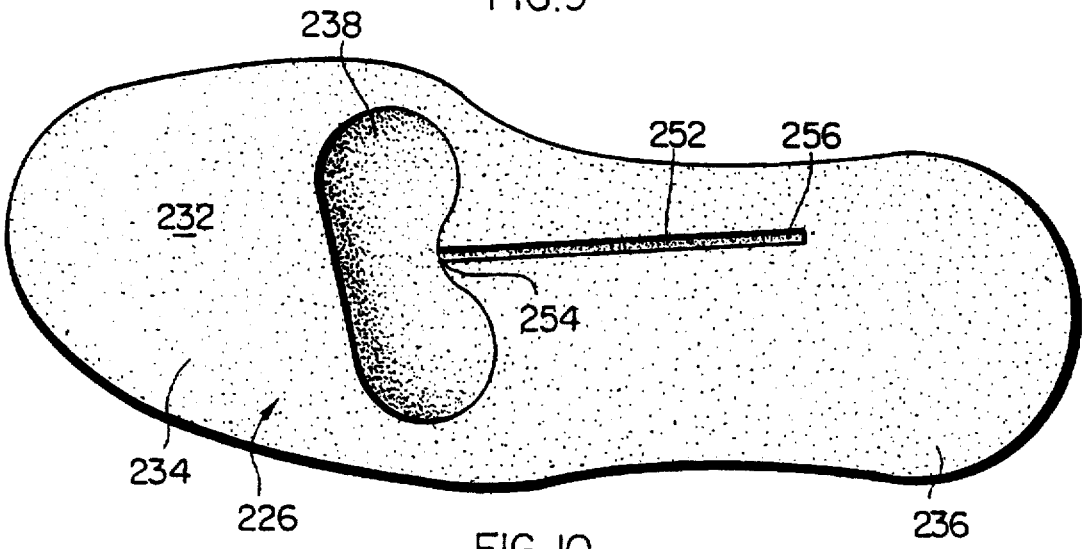
FIG. 9 is a bottom plan view of the midsole of the shoe of FIG. 8, taken generally along the line 9—9 in FIG. 8.
Figure 12:
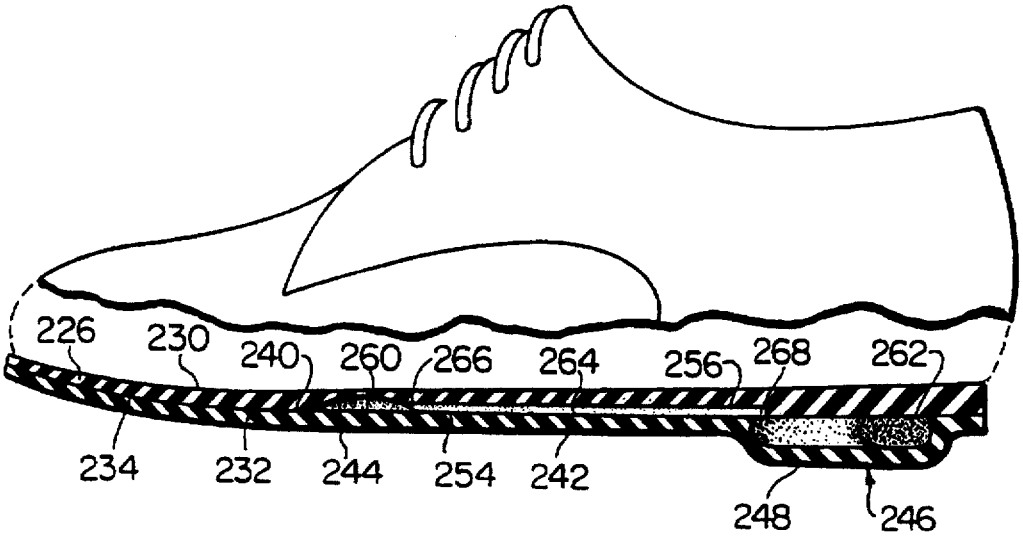
FIG. 12 is a view similar to FIG. 5 of the shoe of FIG. 11, with the sole and heel member shown in section taken along the line 12—12 of FIG. 11.

Referring to FIG. 8, there is illustrated a shoe 220 having a conventional upper portion or last 222. The shoe 220 also includes a two-piece outer sole and heel member 224 which includes a midsole 226 overlying an outsole 228. The midsole 226, as seen in FIG. 12, has an upwardly facing surface 230 which faces a wearer's foot and a downwardly facing surface 232 which faces the outsole 228. The midsole 226 may be made of the same material and by the same method as midsole 26. The midsole 226, as seen in FIGS. 9 and 12, also has a sole portion 234 located under the sole of a wearer's foot and a heel portion 236 located under the heel of a wearer's foot. As seen in FIGS. 9 and 12, the sole portion 234 of the midsole 226 includes a kidney-shaped metatarsal cavity 238 which opens downwardly at the downwardly facing surface 232.

Figure 10:
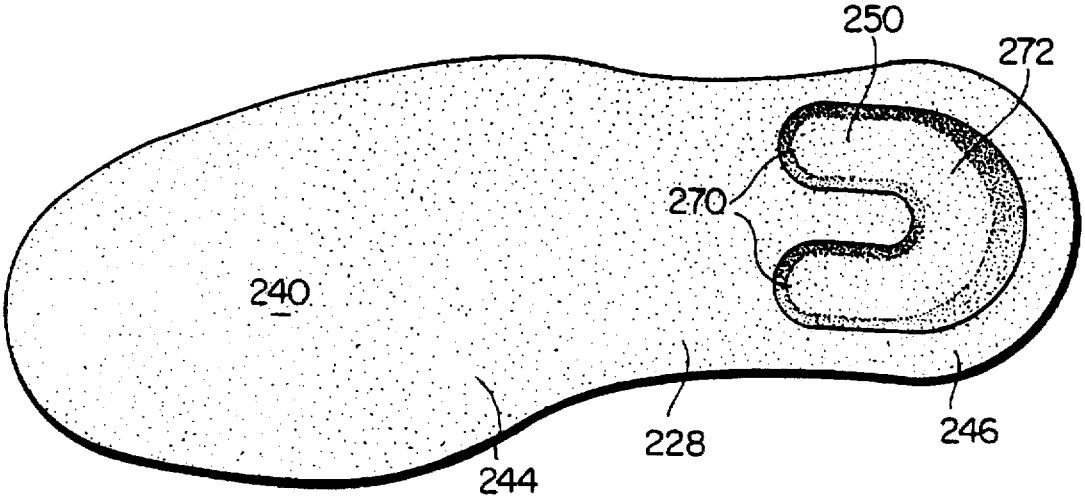
FIG. 10 is a top plan view of the outsole of the shoe of FIG. 8, taken generally along the line 10—10 in FIG. 8.
Figure 11:
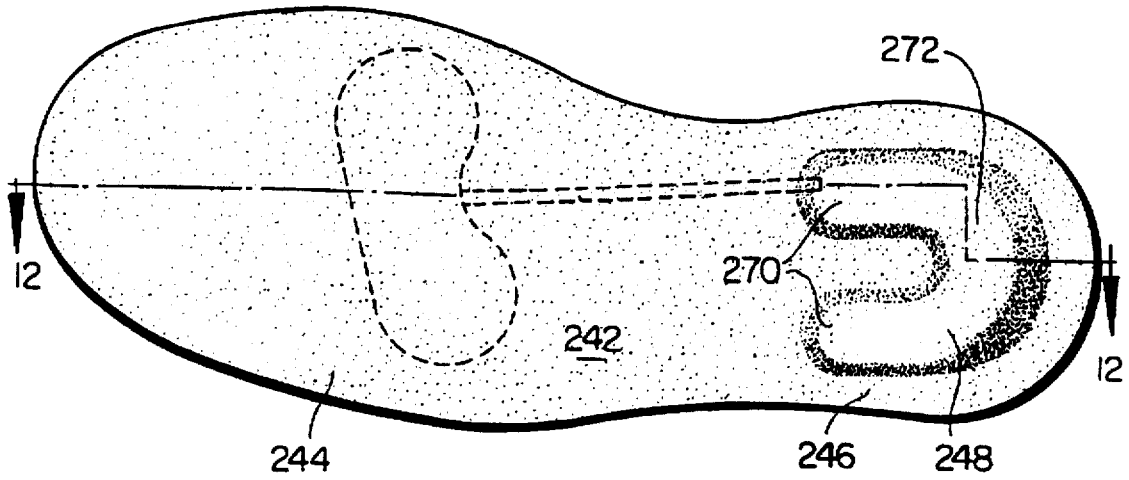
FIG. 11 is a bottom plan view of the shoe of FIG. 8.

The outsole 228 is made of the same material as outsole 28. As seen in FIGS. 10–12, the outsole 228 has an interior surface 240 which faces the midsole 226 and an exterior surface 242. The outsole 228 also has a substantially planar sole portion 244 located under the sole portion 234 of the midsole 226 and the sole of a wearer's foot and a heel portion 246 located under the heel portion 236 of the midsole 226 and the heel of the wearer's foot.

A generally U-shaped heel bulge 248 is molded into the heel portion 244 and projects downwardly from the exterior surface 242. The heel bulge 248 includes a pair of laterally spaced-apart and forwardly projecting legs 270 interconnected at the rear ends thereof by a bight 272. The heel bulge 248 defines a generally U-shaped heel cavity 250 which opens upwardly at the interior surface 240.

A channel cavity 252 is molded into the midsole 226 and opens downwardly at the downwardly facing surface 232. The channel cavity 252 extends from a first end 254 which is connected to the kidney-shaped metatarsal cavity 238 to a second end 256 disposed in the heel portion 236.

An adhesive is disposed between the interior surface 240 of the outsole 228 and the downwardly-facing surface 232 of the midsole 226 for fixedly securing the two together in a fluid-tight manner to hermetically seal and form metatarsal and heel pockets 260 and 262 and a restricted passageway 264 therebetween, permanently trapping air or other fluid at atmospheric pressure therein.

Metatarsal pocket 260 is defined by the kidney-shaped metatarsal cavity 238 and the portion of the outsole 228 underlying the cavity 238. Restricted passageway 264 is defined by channel cavity 252 and the portion of the outsole 228 underlying the channel cavity 252. Heel pocket 262 is defined by the heel cavity 250 and the portion of the midsole 226 overlying the U-shaped heel cavity 250.

As best seen in FIGS. 10–12, restricted passageway 264 has a first opening 266 at the first end 254 of the channel cavity 252 which opens into the metatarsal pocket 260 and a second opening 268 at the second end 256 of the channel cavity 252 which opens downwardly into the heel pocket 262. The restricted passageway 264 thereby allows the metatarsal pocket 260 to fluidly communicate with the heel pocket 262.

In use, the air in pockets 260, 262 provide a cushioning effect. In walking and running, the heel bulge 248 of the outsole 228 first comes in contact with the ground and causes the air to be compressed in the heel pocket 262 and forced through the passageway 264 into the metatarsal pocket 260. As the heel portion lifts off the ground and the sole portion of the outsole 228 contacts the ground, the force of the ground contacting the sole portion 244 of the outsole 228 under the metatarsal pocket 226 and the force of the wearer's foot on the midsole 226 above the metatarsal pocket 260 causes the air in metatarsal pocket 260 to be forced through passageway 264 back into heel pocket 262 to give a lifting effect. Thus in walking and running, the air moves back and forth between the pockets 260 and 262 through the passageway 264 to give an alternating lifting effect and provide thrust both at the metatarsal ball area and in the heel area that facilitates walking and running.

Due to the different forces exerted in use on pockets 260 and 262, and for the same reasons as discussed above for the embodiment shown in FIGS. 1–5, the volume of the pocket which has no portion in direct contact with the ground is smaller than that of the pocket which has a portion which does contact the ground. In this case, metatarsal pocket 260 has a smaller volume than heel pocket 262.

Though the cavities have been shown as being spherical, U-shaped or kidney-shaped, they may take any shape, including those shown in the aforementioned U.S. Pat. Nos. 4,237,625, 4,358,902, 4,577,417, 5,375,346 and 5,416,986, the disclosures of which are incorporated herein by reference.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A shoe sole and heel structure comprising:

an outsole having interior and exterior surfaces and a bulge projecting from the exterior surface, the bulge defining a first cavity opening at the interior surface;

a midsole overlying the outsole, the midsole having an outsole-facing surface and a foot-facing surface and a second cavity opening at the outsole-facing surface;

means for hermetically attaching the interior surface of the outsole to the outsole-facing surface of the midsole to form a member having a sole portion and a heel portion, wherein the first cavity cooperates with a portion of the midsole to define a first pocket and the second cavity cooperates with a substantially flat portion of the outsole to define a second pocket;

a passageway in the member providing fluid communication between the first and second pockets; and fluid at atmospheric pressure permanently disposed in the space jointly defined by the first and second pockets and the passageway;

whereby at rest a foot in a shoe incorporating the structure is cushioned comfortably on the fluid in the pockets.

2. A shoe sole and heel structure comprising:

an outsole having interior and exterior surfaces and a bulge projecting from the exterior surface, the bulge defining a first cavity opening at the interior surface;

a midsole overlying the outsole, the midsole having an outsole-facing surface and a foot-facing surface and a second cavity opening at the outsole-facing surface;

means for hermetically attaching the interior surface of the outsole to the outsole-facing surface of the midsole to form a member having a sole portion and a heel portion, wherein the first cavity cooperates with a portion of the midsole to define a first pocket and the second cavity cooperates with a substantially flat portion of the outsole to define a second pocket;

a passageway in the member providing fluid communication between the first and second pockets; and fluid at atmospheric pressure permanently disposed in the space jointly defined by the first and second pockets and the passageway;

one of the pockets being disposed in the sole portion and the other of the pockets being disposed in the heel portion;

whereby at rest a foot in a shoe incorporating the structure is cushioned comfortably on the fluid in the pockets and during striding such fluid moves through the passageway between the pockets so as to provide shock absorption and an alternating lifting effect by the pockets which provide forward thrust both in the heel portion and the sole portion that facilitates moving.

3. The structure of claim 2, wherein the first pocket is disposed in the sole portion and underlies the metatarsal ball area of a foot for which the shoe is sized and wherein the second pocket is disposed in the heel portion and underlies the heel area of the foot.

4. The structure of claim 3, wherein the passageway includes a channel cavity disposed in the outsole and opening at the interior surface thereof.

5. The structure of claim 3, wherein the passageway includes a channel cavity disposed in the midsole and opening at the outsole-facing surface thereof.

6. The structure of claim 2, wherein the second pocket is disposed in the sole portion and underlies the metatarsal ball area of a foot for which the shoe is sized and wherein the first pocket is disposed in the heel portion and underlies the heel area of the foot.

7. The structure of claim 6, wherein the passageway includes a channel cavity disposed in the outsole and opening at the interior surface thereof.

8. The structure of claim 6, wherein the passageway includes a channel cavity disposed in the midsole and opening at the outsole-facing surface thereof.

9. The structure of claim 6, wherein the first and second pockets respectively have first and second volumes, and the second volume is less than the first volume.

10. A shoe comprising:

a foot-receiving upper and a sole and heel structure secured to the upper;

the structure including:

an outsole having interior and exterior surfaces and a bulge projecting from the exterior surface, the bulge defining a first cavity opening at the interior surface;

a midsole overlying the outsole, the midsole having an outsole-facing surface and a foot-facing surface and a second cavity opening at the outsole-facing surface;

means for hermetically attaching the interior surface of the outsole to the outsole-facing surface of the midsole to form a member having a sole portion and a heel portion, wherein the first cavity cooperates with a portion of the midsole to define a first pocket and the second cavity cooperates with a substantially flat portion of the outsole to define a second pocket;

a passageway in the member providing fluid communication between the first and second pockets; and fluid at atmospheric pressure permanently disposed in the space jointly defined by the first and second pockets and the passageway;

whereby at rest a foot in the shoe is cushioned comfortably on the fluid in the pockets.

11. The structure of claim 10, wherein one of the pockets being disposed in the sole portion and the other of the pockets being disposed in the heel portion, whereby during striding such fluid moves through the passageway between the pockets so as to provide shock absorption and an alternating lifting effect by the pockets which provide forward thrust both in the heel portion and the sole portion that facilitates moving.

12. The shoe of claim 11, wherein the first pocket is disposed in the sole portion and underlies the metatarsal ball area of a foot for which the shoe is sized and wherein the second cavity is disposed in the heel portion and underlies the heel area of the foot.

13. The shoe of claim 12, wherein the passageway includes a channel cavity disposed in the outsole and opening at the interior surface thereof.

14. The shoe of claim 12, wherein the passageway includes a channel cavity disposed in the midsole and opening at the outsole-facing surface thereof.

15. The shoe of claim 12, and further comprising a heel disposed at the heel portion and attached to the exterior surface of the outsole.

16. The shoe of claim 11, wherein the bulge projects from the heel portion and the second pocket is disposed in the sole portion and underlies only the metatarsal ball area of a foot for which the shoe is sized and wherein the first pocket is disposed in the heel portion underlies the heel area of the foot.

17. The shoe of claim 11, wherein the passageway includes a channel cavity disposed in the outsole and opening at the interior surface thereof.

18. The shoe of claim 11, wherein the passageway comprises a channel cavity disposed in the midsole and opening at the outsole-facing surface thereof.

19. The shoe of claim 11, wherein the first and second pockets respectively have first and second volumes, and the second volume is less than the first volume.

* * * * *